US006034008A

United States Patent [19]

Lim et al.

[11] Patent Number: 6,034,008

[45] Date of Patent: Mar. 7, 2000

[54] FLASH-SPUN SHEET MATERIAL

[75] Inventors: Hyun Sung Lim, Midlothian; Larry R Marshall; Wazir Nobbee, both of Chesterfield; Jennifer Marie Warren, Richmond, all of Va.

[73] Assignee: E. I. Du Pont de Nemours and Company, Wilmington, Del.

[21] Appl. No.: 08/966,166

[22] Filed: Nov. 7, 1997

Related U.S. Application Data

[63] Continuation-in-part of application No. 08/914,410, Aug. 19, 1997, and a continuation-in-part of application No. 08/699,281, Aug. 19, 1996, abandoned.

[51] Int. Cl.[7] ..... D04H 1/00

[52] U.S. Cl. ..... 442/334; 264/205; 428/304.4

[58] Field of Search ..... 442/334; 428/304.4; 264/205

[56] References Cited

U.S. PATENT DOCUMENTS

| | | | |
|---|---|---|---|
| 3,081,519 | 3/1963 | Blades et al. | 28/81 |
| 3,227,794 | 1/1966 | Anderson et al. | 264/205 |
| 3,427,376 | 2/1969 | Dempsey | 264/282 |
| 3,478,141 | 11/1969 | Dempsey et al. | 264/284 |
| 3,532,589 | 10/1970 | David | 161/150 |
| 3,860,369 | 1/1975 | Brethauer et al. | 425/3 |
| 3,946,780 | 3/1976 | Sellers | 150/8 |
| 4,539,256 | 9/1985 | Shipman | 428/315.5 |
| 4,617,124 | 10/1986 | Pall et al. | 210/638 |
| 4,652,322 | 3/1987 | Lim | 156/181 |
| 4,724,078 | 2/1988 | Auriol et al. | 210/490 |
| 5,023,130 | 6/1991 | Simpson et al. | 428/227 |
| 5,032,326 | 7/1991 | Shin | 264/13 |
| 5,147,586 | 9/1992 | Shin et al. | 264/13 |
| 5,250,237 | 10/1993 | Shin | 264/13 |
| 5,308,691 | 5/1994 | Lim et al. | 428/286 |
| 5,476,589 | 12/1995 | Bacino | 210/500.36 |

FOREIGN PATENT DOCUMENTS

| | | | |
|---|---|---|---|
| 0 370 835 A2 | 5/1990 | European Pat. Off. | B32B 5/26 |

OTHER PUBLICATIONS

S. Nago and Y. Mizutani, Microporous Polypropylene Sheets Containing Polymethylsilsesquioxane Filler, *Journal of Applied Polymer Science*, 50, 1815–1822, 1993.

Y. Mizutani, S. Nakamura, S. Kaneko, K. Okamura, Microporous Polypropylene Sheets, *Am. Che. Soc., Div. Fuel Chem.*, 20, 122, 1975.

Dr. Ernest Mayer, New Tyvek® Filtration Media to Replace Tyvek® T–980—Presented at the American Filtration and Separation Society's Advancing Filtration Solutions Conference held Apr. 28–May 2, 1997 in Minneapolis, Minnesota.

Dr. Ernest Mayer, Estimating Media Blinding Via Coulter Porometer™ Analyses—Presented at the American Filtration and Separation Society's Advancing Filtration Solutions Conference held Apr. 28–May 2, 1997 in Minneapolis, Minnesota.

*Primary Examiner*—James J. Bell

[57] ABSTRACT

This invention relates to improved sheets of flash-spun plexifilamentary film-fibrils useful in fluid microfiltration and sterile packaging. The sheet material suitable for use in microfiltration of liquids has a permeability that causes a pressure drop of less than 21 kPa at a water flow rate per unit area of 12.55 ml/min/cm$^2$, and that has a filtration efficiency of 99% of dust particulates in the size range of 1 to 2 microns suspended in a stream of distilled water pumped through the sheet material at a pressure differential of 207 kPa. The sheet material suitable for use in sterile packaging that has a Gurley Hill Porosity of less than 15 seconds and a bacteria spore log reduction value of at least 2.5.

19 Claims, 2 Drawing Sheets

FLASH-SPUN SHEET MATERIAL

This application is a continuation-in-part of U.S. patent application Ser. No. 08/914,410 filed on Aug. 19, 1997, and a continuation-in-part of U.S. patent application Ser. No. 08/699,281 filed on Aug. 19, 1996, now abandoned.

FIELD OF THE INVENTION

This invention relates to sheets or fabrics suited for filter materials as well as to other end use applications in which a sheet or fabric must demonstrate good barrier properties as well as good air or liquid permeability.

BACKGROUND OF THE INVENTION

Porous sheet materials are used in the filtration of water, wastewater, and other fluids. For example, such filtration materials are used to remove dirt, dust, particulates, suspended solids, heavy metals and other matter from liquid streams. Porous sheet materials are also used in applications where it is necessary to filter out microbes such as spores and bacteria. For example, porous sheet materials are used in the packaging of sterile medical items, such as surgical instruments. In sterile packaging, the porous packaging material must be porous to gases such as ethylene oxide that are used to kill bacteria on items being sterilized, but the packaging materials must be impervious to bacteria that might contaminate sterilized items. Another application for porous sheet materials with good barrier properties is for making pouches that hold moisture absorbing desiccant substances. Such desiccant pouches are frequently used in packaged materials to absorb unwanted moisture.

The physical properties of a fabric or sheet material determine the filtration applications for which the material is suited. It has been found desirable for sheet materials used in a variety of filtration applications to provide good barrier to the passage of fine particles but also have good permeability to gases and/or liquids. Another set of desirable properties for fabrics or sheet materials used in certain filtration applications is that the material have enough strength and tear resistance that filters made using the sheet material will not lose their integrity under anticipated working conditions. Finally, most filter materials must have a manufacturing cost that is low enough to make the use of the material practical in low cost filters.

A number of standardized tests have been devised to characterize materials used in filtration and in sterile packaging so as to allow others to compare properties and make decisions as to which materials are best suited to meet the various anticipated conditions or circumstances under which a material will be required to serve. The strength and durability of sheet materials has been quantified in terms of tensile strength, tear strength and elongation. The primary tests used for characterizing filtration efficacy are tests that measure filter efficiency (% of particulates retained by a filter); resistance to water flow through a filter at a given flow rate (also known as clean permeability); and life of a filter material under a given loading and operation condition (also known as capacity). Barrier properties can be measured by both bacterial or particulate barrier tests.

TYVEK® spunbonded olefin has been in use for a number of years as a material for filtration and sterile packaging applications. E. I. du Pont de Nemours and Company (DuPont) makes and sells TYVEK® spunbonded olefin nonwoven fabric. TYVEK® is a registered trademark owned by DuPont. TYVEK® nonwoven fabric has been a good choice for filtration and sterile packaging applications because of its excellent strength properties, its good barrier properties, its reasonable permeability, its light weight, and its single layer structure that gives rise to a low manufacturing cost relative to most competitive materials. While TYVEK® spunbonded olefin has proved to have excellent barrier properties for filtration of water and wastewater, its limited permeability requires differential pressures across the filter media that are larger than is desirable. Similarly, while TYVEK® spunbonded olefin has proved to have excellent barrier properties for sterile packaging, the material's relatively low permeability lengthens the cycle times needed for injecting and removing sterilizing gases during sterilization procedures.

Thus, there is a need for a sheet material suitable for use in filtration and sterile packaging that has strength, weight and barrier properties at least equivalent to that of the TYVEK® spunbonded olefin nonwoven sheet material that has been traditionally used for such applications, but that also has significantly improved air and liquid permeability to make use of the material as a filtration material more efficient.

SUMMARY OF THE INVENTION

The above and other properties of the present invention are achieved by a sheet material suitable for use in microfiltration of liquids having a permeability that causes a pressure drop of less than 21 kPa (3 psi) at a water flow rate per unit area of 12.55 ml/min/cm$^2$, and that has a filtration efficiency of 99% of dust particulates in the size range of 1 to 2 microns at a pressure differential of 207 kPa (30 psi). The sheet material is preferably comprised substantially exclusively of a unitary sheet of nonwoven fibers. More preferably, the nonwoven fibers are flash-spun plexifilamentary fibrils comprised of polyolefin polymer such as high density polyethylene.

The sheet of the preferred embodiment of the invention has a basis weight that is less than about 45 g/m$^2$, and a tensile strength in both the machine and cross directions of at least 1500 N/m.

According to another embodiment of the invention, a sheet material suitable for use in sterile packaging is provided that has a Gurley Hill Porosity of less than 15 seconds and a spore log reduction value of at least 2.5.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily drawn to scale.

DETAILED DESCRIPTION OF THE PREFERRED EMBODIMENT

The process for making flash-spun nonwoven products, and specifically TYVEK® spunbonded olefin, was first developed more than twenty-five years ago and put into commercial use by DuPont. U.S. Pat. No. 3,081,519 to Blades et al. (assigned to DuPont), describes a process wherein a solution of fiber-forming polymer in a liquid spin agent that is not a solvent for the polymer below the liquid's normal boiling point, at a temperature above the normal boiling point of the liquid, and at autogenous pressure or greater, is spun into a zone of lower temperature and substantially lower pressure to generate plexifilamentary film-fibril strands.

As disclosed in U.S. Pat. No. 3,227,794 to Anderson et al. (assigned to DuPont), plexifilamentary film-fibril strands are best obtained using the process disclosed in Blades et al. when the pressure of the polymer and spin agent solution is reduced slightly in a letdown chamber just prior to flash-spinning.

The term "plexifilamentary" as used herein, means a three-dimensional integral network of a multitude of thin, ribbon-like, film-fibril elements of random length and with a mean film thickness of less than about 4 microns and a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

Flash-spinning of polymers using the process of Blades et al. and Anderson et al. requires a spin agent that: (1) is a non-solvent to the polymer below the spin agent's normal boiling point; (2) forms a solution with the polymer at high pressure; (3) forms a desired two-phase dispersion with the polymer when the solution pressure is reduced slightly in a letdown chamber; and (4) flash vaporizes when released from the letdown chamber into a zone of substantially lower pressure. Depending on the particular polymer employed, the following compounds have been found to be useful as spin agents in the flash-spinning process: aromatic hydrocarbons such as benzene and toluene; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as trichlorofluoromethane, methylene chloride, carbon tetrachloride, dichloroethylene, chloroform, ethyl chloride, methyl chloride; alcohols; esters; ethers; ketones; nitrites; amides; fluorocarbons; sulfur dioxide; carbon dioxide; carbon disulfide; nitromethane; water; and mixtures of the above liquids. Various solvent mixtures useful in flash-spinning are disclosed in U.S. Pat. No. 5,032,326 to Shin; U.S. Pat. No. 5,147,586 to Shin et al.; and U.S. Pat. No. 5,250,237 to Shin (all assigned to DuPont).

Figure 1:
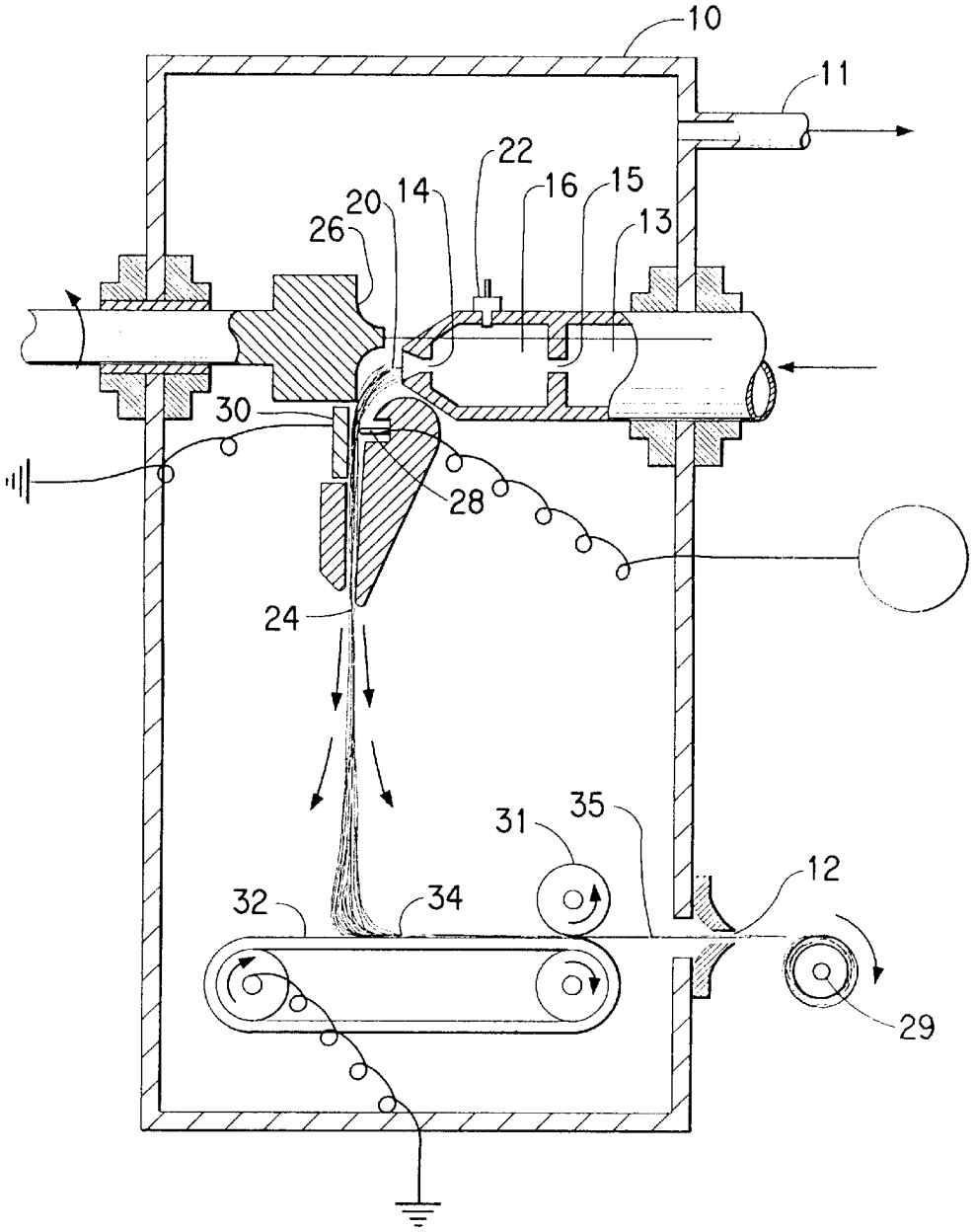
FIG. 1 (PRIOR ART)
FIG. 1 a schematic cross sectional view of a spin cell illustrating the basic process for making flash-spun nonwoven products.

The process for flash-spinning sheets comprised of plexifilamentary film-fibril strands is illustrated in FIG. 1, and is similar to that disclosed in U.S. Pat. No. 3,860,369 to Brethauer et al., which is hereby incorporated by reference. The flash-spinning process is normally conducted in a chamber 10, sometimes referred to as a spin cell, which has an exhaust port 11 for exhausting the spin cell atmosphere to a spin agent recovery system and an opening 12 through which non-woven sheet material produced in the process is removed.

Figure 2:
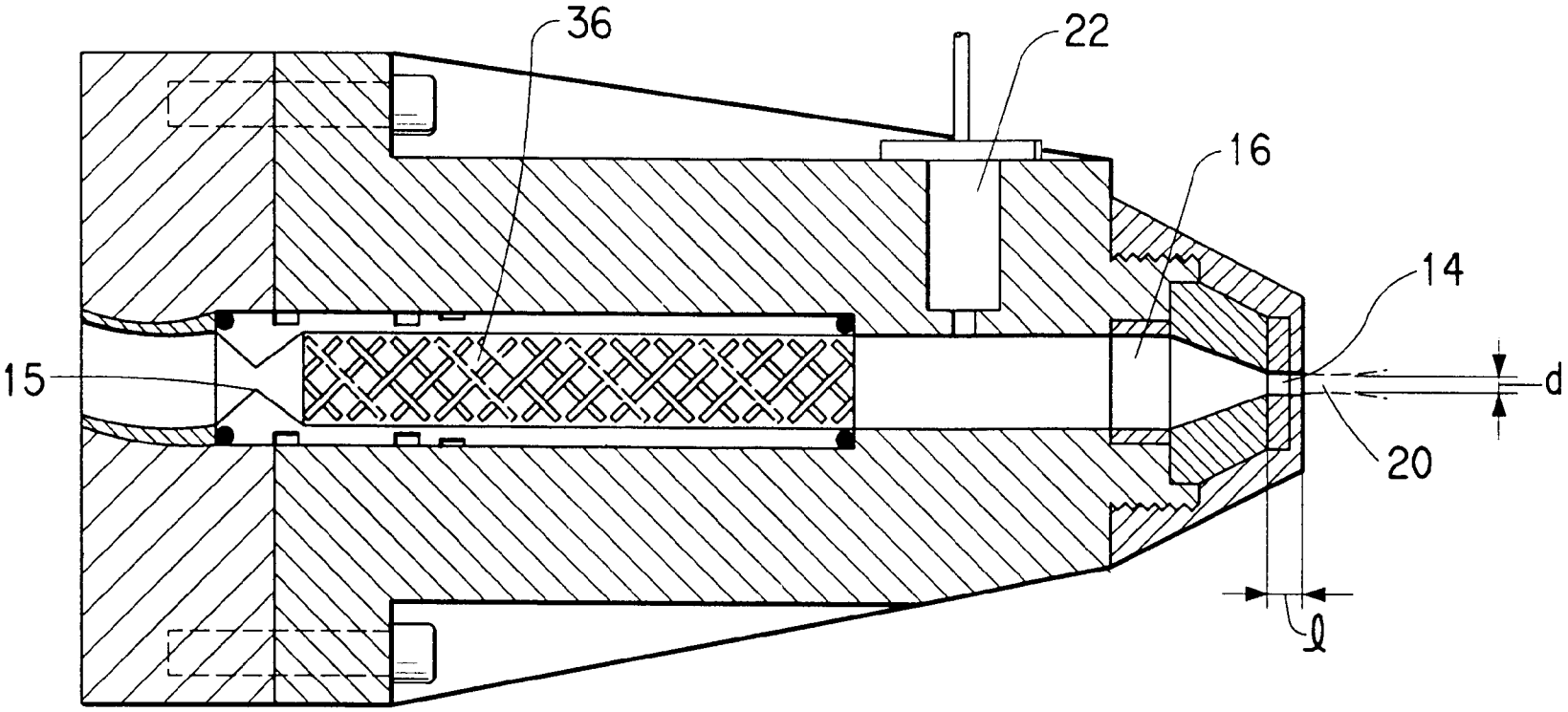
FIG. 2 is an enlarged cross sectional view of the spinning equipment for flash-spinning fiber.

A solution of polymer and spin agent is provided through a pressurized supply conduit 13 to a letdown orifice 15 and into a letdown chamber 16. The pressure reduction in the letdown chamber 16 precipitates the nucleation of polymer from a polymer solution, as is disclosed in U.S. Pat. No. 3,227,794 to Anderson et al. One option for the process is to include an inline static mixer 36 (see FIG. 2) in the letdown chamber 16. A suitable mixer is available from Koch Engineering Company of Wichita Kans. as Model SMX. A pressure sensor 22 may be provided for monitoring the pressure in the chamber 16. The polymer mixture in chamber 16 next passes through spin orifice 14. It is believed that passage of the pressurized polymer and spin agent from the letdown chamber 16 into the spin orifice 14 generates an extensional flow near the approach of the orifice that helps to orient the polymer into elongated polymer molecules. As the polymer passes through the spin orifice, the polymer molecules are further stretched and aligned. When polymer and spin agent discharge from the spin orifice 14, the spin agent rapidly expands as a gas and leaves behind fibrillated plexifilamentary film-fibrils. The spin agent's expansion during flashing accelerates the polymer so as to further stretch the polymer molecules just as the film-fibrils are being formed and the polymer is being cooled by the adiabatic expansion. The quenching of the polymer freezes the linear orientation of the polymer molecule chains in place, which contributes to the strength of the resulting flash-spun plexifilamentary polymer structure.

The gas exits the chamber 10 through the exhaust port 11. The polymer strand 20 discharged from the spin orifice 14 is conventionally directed against a rotating lobed deflector baffle 26. The rotating baffle 26 spreads the strand 20 into a more planar web structure 24 that the baffle alternately directs to the left and right. As the spread web descends from the baffle, the web is passed through an electric corona generated between an ion gun 28 and a target plate 30. The corona charges the web so as to hold it in a spread open configuration as the web 24 descends to a moving belt 32 where the web forms a batt 34. The belt is grounded to help insure proper pining of the charged web 24 on the belt. The fibrous batt 34 is passed under a consolidation roll 31 that compresses the batt into a sheet 35 formed with plexifilamentary film-fibril networks oriented in an overlapping multi-directional configuration. The sheet 35 exits the spin chamber 10 through the outlet 12 before being collected on a sheet collection roll 29.

The sheet 35 is subsequently run through a finishing line which treats and bonds the material in a manner appropriate for its end use. For example, the sheet product may be whole surface bonded on a smooth heated roll as disclosed in U.S. Pat. No. 3,532,589 to David (assigned to DuPont) in order to produce a hard sheet product. According to this bonding process, both sides of the sheet are subjected to generally uniform, full surface contact thermal bonding. Alternatively, the sheet 35 may be whole surface bonded and stretched on smaller bonding rolls as disclosed in U.S. Pat. No. 4,652,322 to Lim (assigned to DuPont). The whole surface bonded "hard structure" product has the feel of slick paper and is used commonly in overnight mailing envelopes, for construction membrane materials such as TYVEK® Homewrap™, in sterile packaging, and in filters. Homewrap™ is a trademark of DuPont. For apparel applications, the sheet 35 is typically point bonded and softened as disclosed in U.S. Pat. Nos. 3,427,376 and 3,478,141 (both assigned to DuPont) to produce a "soft structure" product with a more fabric-like feel.

It is thought that the full surface bonding of a "hard structure" flash-spun sheet product causes the high surface area plexifilamentary fibers of the sheet to shrink, which in turn causes the pores between the fibers to open up. Accordingly, "hard structure" sheet products generally have higher moisture vapor transmission rates and higher hydrostatic head values as compared to "soft structure" sheet products. Thus, when describing the physical properties of flash-spun sheet products, it may sometimes be important to differentiate between hard and soft structure products.

Handle-o-meter stiffness measurements can be used to differentiate hard and soft structure products. For purposes of comparison, such stiffness values are normalized to the basis weight (divided by basis weight).

TYVEK® Style 1042B, a hard structure material having a low basis weight of 1.25 oz/yd$^2$ (42.4 g/m$^2$) has a handle-o-meter stiffness of 1290 mN which can be normalized to 30.4 mN/g/m$^2$. Heavier basis weight "hard structure" sheets are expected to be at least as stiff, even when normalized, as the Style 1042B material. The point bonded "soft structure" product TYVEK® Style 1422A, which has a basis weight of 1.2 oz/yd$^2$ (40.7 g/m$^2$), has a Handle-o-meter stiffness of 430 mN, or a normalized stiffness of 10.6 mN/g/m$^2$. The heavier weight "soft structure" TYVEK® Style 1673, with a basis weight of 2.10 oz/yd$^2$ (71.2 g/m$^2$) and a Handle-o-meter of 1640 mN, has a normalized stiffness of 23.1 mN/g/m$^2$. A normalized stiffness of greater than about 25 mN/g/m$^2$ in a flash-spun sheet is indicative of a "hard structure" product, and a normalized stiffness of greater than 28 mN/g/m$^2$ will very clearly be a "hard structure" sheet product.

It should be recognized that properties such as permeability and hydrostatic head of a flash-spun sheet or fabric material may be modified by post spinning treatment such as bonding and corona treatment. While excessive bonding can be used to increase a property such as permeability of a flash-spun sheet, such bonding may cause other important properties to fall below that which is acceptable. For example, excessive bonding of a flash-spun polyolefin sheet material normally causes the material's opacity to drop below the level that is deemed minimally acceptable for packaging end uses. High bonding levels can only contribute a limited amount to the permeability of a flash-spun sheet because after a certain level of bonding is reached, the sheet becomes a film with little or no permeability. Thus, it is necessary to find other means for increasing the permeability of flash-spun sheet materials.

Historically, the preferred spin agent used in making TYVEK® flash-spun polyethylene has been the chlorofluorocarbon (CFC) spin agent, trichlorofluoromethane (FREON®-11). FREON® is a registered trademark of DuPont. When FREON®-11 is used as the spin agent, the spin solution has been comprised of about 12% by weight of polymer with the remainder being spin agent. The temperature of the spin solution just before flashing has historically been maintained at about 180° C.

It has now been found that it is possible to flash-spin finer plexifilamentary fibers that, when laid down and bonded, make a fabric or sheet that is significantly more permeable than the TYVEK® fabric or sheet material produced from a 12% polyethylene/88% FREON®-11 solution at a spin temperature of about 180° C., and with at least equivalent strength and barrier properties. This more permeable material has been found to have great utility in filter and sterile packaging materials where increased permeability permits the materials to perform their function in a more efficient manner.

Applicants have found that improved fabric sheet permeability can be attained, when flash-spun polyethylene fabric or sheet material is manufactured using a FREON®-11 based spin solution, by reducing the concentration of the polymer in the spinning solution and by raising the temperature at which the spinning solution is maintained prior to flashing. As disclosed in the examples below, reducing the concentration of polyethylene in the FREON®-11 based spin solution to between 9% and 11% of the spin solution and increasing the spinning temperature to between 185° to 195° C. has been found to significantly improve the permeability of the bonded fabric material produced without causing a substantial reduction in strength or barrier properties.

Without wishing to be bound by theory, it is presently believed that as the polymer concentration is reduced the average fiber size becomes smaller, and as the solution spin temperature is increased the fibers become less cohesive. The smaller fibers are believed to result in sheet layers with fewer thicker portions therein and with a larger number of smaller pores. However, the sheet appears to have an overall structure that is less cohesive with larger void spaces between the layers in the plane of the sheet. The end result seems to be a sheet that allows more gas and vapor to pass making the material much more permeable. The data in Examples 22 and 23 below show that the mean fiber size of the fibers before bonding is smaller for the higher permeability sample spun at a lower polymer concentration and an increased solution temperature (Ex. 23).

Applicants have also found that it is possible to flash-spin a polyethylene fabric or sheet material with improved permeability and with barrier strength properties equivalent to conventional flash-spun polyethylene sheets by flash-spinning the sheet from a hydrocarbon-based spin solution comprised of between 12% and 16% by weight polyethylene and maintained at a temperature of between 185° to 195° C. prior to flashing. Such materials are more fully disclosed in the examples below.

Importantly, the more permeable fabric or sheet material of the present invention maintains the strength of conventional TYVEK® flash-spun polyethylene sheets because of the molecular orientation of the polymer in the fibers and because it is made in a single laydown process with a single polymer. In addition, recyclability and lower cost are built into the uniform flash-spun fabrics or sheet materials of the present invention as compared to the laminated products with which the material of the invention must compete in the marketplace. As used herein, the term "unitary sheet" is used to designate a nonwoven sheet made exclusively of similar fibers of a single polymer, and that is free of laminations or other support structures. Finally, the flash-spun fabric material of the present invention has filtration efficiency, barrier and strength properties suitable for filtration at a commercial basis weight of 42.4 g/m$^2$ (1.25 oz/yd$^2$) which compares quite favorably to the heavier competitive laminated products, such a polytetrafluoroethylene membrane laminated to a polypropylene felt, which has a basis weight of 542.6 g/m$^2$ (16 oz/yd$^2$) or greater.

This invention will now be illustrated by the following non-limiting examples which are intended to illustrate the invention and not to limit the invention in any manner.

EXAMPLES

In the description above and in the non-limiting examples that follow, the following test methods were employed to determine various reported characteristics and properties. ASTM refers to the American Society for Testing and Materials, AATCC refers to the American Association of Textile Chemists and Colorists, INDA refers to the Association of the Nonwovens Fabrics Industry, and TAPPI refers to the Technical Association of Pulp and Paper Industry.

Basis Weight was determined by ASTM D 3776, which is hereby incorporated by reference, and is reported in g/m$^2$. The basis weights reported for the examples below are each based on an average of at least twelve measurements made on the sample.

Tensile Strength and Work to Break were determined by ASTM D 1682, Section 19, which is hereby incorporated by reference, with the following modifications. In the test, a 2.54 cm by 20.32 cm (1 inch by 8 inch) sample was clamped at its opposite ends. The clamps were attached 12.7 cm (5 in) from each other on the sample. The sample was pulled steadily at a speed of 5.08 cm/min (2 in/min) until the sample broke. The force at break was recorded in Newtons/cm as the breaking tensile strength. The area under the stress-strain curve was the work to break.

Grab Tensile Strength was determined by ASTM D 1682, Section 16, which is hereby incorporated by reference, and is reported in Newtons.

Elongation to Break of a sheet is a measure of the amount a sheet stretches prior to failure (breaking) in a strip tensile test. A 1.0 inch (2.54 cm) wide sample is mounted in the clamps—set 5.0 inches (12.7 cm) apart—of a constant rate of extension tensile testing machine such as an Instron table model tester. A continuously increasing load is applied to the sample at a crosshead speed of 2.0 in/min (5.08 cm/min) until failure. The measurement is given in percentage of stretch prior to failure. The test generally follows ASTM D 1682-64.

Hydrostatic Head is a measure of the resistance of the sheet to penetration by water under a static load. A 7×7 in (17.78×17.78 cm) sample is mounted in a SDL 18 Shirley Hydrostatic Head Tester (manufactured by Shirley Developments Limited, Stockport, England). Water is pumped against one side of a 102.6 $cm^2$ section of the sample at a rate of 60+/−3 cm/min until three areas of the sample are penetrated by the water. The hydrostatic pressure is measured in inches, converted to SI units and is expressed in centimeters of water. The test generally follows ASTM D 583 (withdrawn from publication November, 1976).

Moisture Vapor Transmission Rate (MVTR) is determined by two methods: ASTM E 96, Method B, and ASTM E 398-83 (which has since been withdrawn), which are hereby incorporated by reference. MVTR is reported in $g/m^2/24$ hr. MVTR data acquired using ASTM E 96, Method B is labeled herein simply as "MVTR" data. MVTR data acquired by ASTM E 398-83 was collected using a Lyssy MVTR tester model L80-4000J and is identified herein as "MVTR-LYSSY" data. Lyssy is based in Zurich, Switzerland. MVTR test results are highly dependent on the test method used and material type. Important variables between test methods include pressure gradient, volume of air space between liquid and sheet sample, temperature, air flow speed over the sample and test procedure.

ASTM E 96, Method B is a gravimetric method that uses a pressure gradient of 100% relative humidity (wet cup) vs. 55% relative humidity (ambient). ASTM E 96, Method B is based on a real time measurement of 24 hours during which time the humidity delta changes and the air space between the water in the cup and the sample changes as the water evaporates.

ASTM E 398-83 (the "LYSSY" method) is based on a pressure gradient of 85% relative humidity ("wet space") vs. 15% relative humidity ("dry space"). The LYSSY method measures the moisture diffusion rate for just a few minutes and under a constant humidity delta, which measured value is then extrapolated over a 24 hour period.

The LYSSY method provides a higher MVTR value than ASTM E 96, Method B for a permeable fabric like the flash-spun sheet material of the invention. Use of the two methods highlights the differences in MVTR measurements that can result from using different test methods.

Gurley Hill Porosity is a measure of the permeability of the sheet material for gaseous materials. In particular, it is a measure of how long it takes for a volume of gas to pass through an area of material wherein a certain pressure gradient exists. Gurley-Hill porosity is measured in accordance with TAPPI T-460 OM-88 using a Lorentzen & Wettre Model 121D Densometer. This test measures the time required for 100 cubic centimeters of air to be pushed through a one inch diameter sample under a pressure of approximately 4.9 inches of water. The result is expressed in seconds and is frequently referred to as Gurley Seconds.

Frazier Porosity is a measure of air permeability of porous materials and is reported in units of $ft^3/ft^2/min$. It measures the volume of air flow through a material at a differential pressure of 0.5 inches water. An orifice is mounted in a vacuum system to restrict flow of air through sample to a measurable amount. The size of the orifice depends on the porosity of the material. Frazier porosity is measured in units of $ft^3/ft^2/min$ using a Sherman W. Frazier Co. dual manometer with calibrated orifice.

Opacity relates to how much light is permitted to pass through a sheet. One of the qualities of TYVEK® sheet is that it is opaque and one cannot see through it. Opacity is the measure of how much light is reflected or the inverse of how much light is permitted to pass through a material. It is measured as a percentage of light reflected. Although opacity measurements are not given in the following data tables, all of the examples have opacity measurements above 90 percent and it is believed that an opacity of at least about 85 is minimally acceptable for many end uses.

Handle-o-meter Stiffness is a measure of the resistance of a specimen from being pressed into a 10 mm slot using a 40 gm pendulum. It is measured by INDA IST 90.3-92 and is expressed in mN. As one would expect, the stiffness tends to increase with basis weight. Thus, the stiffness is frequently normalized by dividing the stiffness value by the basis weight.

Bacteria Spore Penetration is measured according to ASTM F 1608-95, which is hereby incorporated by reference. According to this method, a sheet sample is exposed to an aerosol of bacillus subtilis var. niger spores for 15 minutes at a flow rate through the sample of 2.8 liters/min. Spores passing through the sample are collected on a media and are cultured and the number of cluster forming units are measured. The log reduction value ("LRV") expresses the difference, measured in log scale, between the number of cluster forming units on the control media and the number of cluster forming units on the media that was behind the sample. For example, an LRV of 5 represents a difference of 100,000 cluster forming units.

Filtration Efficiency, Permeability and Filter Life are measured with a procedure based on ASTM F 795-82, which is hereby incorporated by reference. The Filtration Efficiency test determines the percentage of particles of the 0.5 to 150 micron size range suspended in stream of distilled water at ambient temperature that are retained by a filter material. According to the method, a concentrated suspension of AC Fine Test Dust is injected into the water stream upstream of the filter. At a given pressure differential, the number of particles in the size range of 1 to 2 microns upstream and downstream of the filter is measured to determine the filtration efficiency as follows:

$$\text{Efficiency} = \frac{\text{(number of particles upstream)} - \text{(number of particles downstream)}}{\text{(number of particles upstream)}} \times 100$$

Permeability is measured by a method that determines the resistance to the flow of water through a material, and is expressed in terms of the pressure drop necessary to drive a given flow of water through a sample of a given area (e.g., a round sample with an effective area of 50.26 $cm^2$). Permeability is expressed in units of differential pressure (kPa) across the filter media at a given water flow rate (e.g., 21 kPa pressure drop@12.55 ml/min/$cm^2$).

Filter Life is a measure of the duration of a filter's useful service that is also known as filter capacity. Filter Life is measured by subjecting a filter to a flow of a standard contaminant and is expressed in terms of the time and amount of contaminant causing the differential pressure across the filter to increase to an unacceptable level. In the Examples below, Filter Life is measured at an initial differential pressure of 0 psi and is expressed in terms of the time and amount of contaminant it takes for the media to reach an unacceptably high pressure of 207 kPa (30 psi).

Mean Pore Size is a measure of the filter pore size at which half of the total air flow through the sample occurs through pores larger than the mean, and half of the air flow occurs through pores smaller than the mean. Mean pore size is measured using a Coulter-II porometer manufactured by Coulter Electronics Ltd. of Luton, England.

Examples 1–8

In the Examples 1–8, nonwoven sheets were flash-spun from high density polyethylene with a melt index of 0.70 g/10 minutes (@190° C. with a 2.16 kg weight), a melt flow ratio {MI (@190° C. with a 2.16 kg weight)/MI (@190° C. with a 21.6 kg weight)} of 34, and a density of 0.96 g/cc. The sheets were flash-spun according to the process described above under one of two spin conditions. Under Condition A, the spin solution comprised of 88% FREON®-11 and 12% high density polyethylene, and the spinning temperature was 180° C. Under Condition B, the spin solution comprised 84% n-pentane and 16% high density polyethylene, and the spinning temperature was 175° C. The sheets of Examples 2, 4, 6 and 8 were produced under condition A, and the sheets of Examples 1, 3, 5, and 7 were produced under Condition B. Sheet samples produced under Condition A were paired with samples produced under Condition B, and four such sample pairs were bonded on the same 34" thermal bonder using a linen and "P" point pattern without mechanical softening. The samples of each sample pair were subjected to the same bonding conditions. The bonding conditions and sheet properties are reported in Table 1, below.

TABLE 1

| | Ex. 1 | Ex. 2 | Ex. 3 | Ex. 4 |
|---|---|---|---|---|
| Spinning Condition | B | A | B | A |
| Bonding Conditions | | | | |
| Steam Pressure (kPascal-gauge) | 385 | 385 | 440 | 440 |
| Bonding Temp. (° C.) | 131 | 133 | ~136 | 136 |
| Nip Pressure (kPascal) | 3450 | 3450 | 3450 | 3450 |
| Physical Properties | | | | |
| MVTR (g/$m^2$/day) | 1079 | 710 | 1119 | 745 |
| MVTR-LYSSY (g/$m^2$/day) | — | — | — | — |
| Hydrostatic Head (cm) | 185 | 163 | 203 | 142 |
| Basis Weight (g/$m^2$) | 42.0 | 42.4 | 41.7 | 42.4 |
| Delamination (N/m) | 12.5 | 10.5 | 14 | 12.5 |
| Crock Meter - Linen Side (# of Strokes) | 2 | 7 | 3 | 3 |
| Crock Meter - "P" Side (# of Strokes) | 11 | 4 | 17 | 6 |
| Tensile Strength MD (N/m) | 1600 | 1250 | 1600 | 1250 |
| Tensile Strength XD (N/m) | 1750 | 1750 | 2100 | 1600 |
| Elongation MD (%) | 13 | 8 | 14 | 8 |
| Elongation XD (%) | 18 | 13 | 19 | 14 |
| Tongue Tear MD (N/m) | 550 | 550 | 550 | 550 |
| Tongue Tear XD (N/m) | 550 | 550 | 550 | 550 |
| Thickness (μm) | 130 | 137 | 122 | 142 |
| Density (g/cm) | 0.323 | 0.309 | 0.342 | 0.299 |

TABLE 1-continued

| | Ex. 5 | Ex. 6 | Ex. 7 | Ex. 8 |
|---|---|---|---|---|
| Spinning Condition | B | A | B | A |
| Bonding Conditions | | | | |
| Steam Pressure (kPascal) | 470 | 470 | 485 | 485 |
| Bonding Temp. (° C.) | 136 | 137 | 139 | 137 |
| Nip Pressure (kPascal) | 3450 | 3450 | 5515 | 5515 |
| Physical Properties | | | | |
| MVTR (g/$m^2$/day) | 1174 | 802 | 910 | 541 |
| MVTR-LYSSY (g/$m^2$/day) | 1139 | 926 | 1035 | — |
| Hydrostatic Head (cm) | 198 | 160 | 238 | 172 |
| Basis Weight (g/$m^2$) | 41.4 | 43.1 | 41.0 | 42.7 |
| Delamination (N/m) | 14 | 12.5 | 19.5 | 14 |
| Crock Meter - Linen Side (# of Strokes) | 3 | 11 | 19 | 19 |
| Crock Meter - "P" Side (# of Strokes) | 18 | 2 | 21 | 14 |
| Tensile Strength MD (N/m) | 1600 | 1400 | 2300 | 2100 |
| Tensile Strength XD (N/m) | 2100 | 1750 | 2650 | 2450 |
| Elongation MD (%) | 13 | 10 | 16 | 14 |
| Elongation XD (%) | 22 | 14 | 19 | 16 |
| Tongue Tear MD (N/m) | 550 | 350 | 350 | 350 |
| Tongue Tear XD (N/m) | 550 | 550 | 550 | 350 |
| Thickness (μm) | 130 | 155 | 107 | 130 |
| Density (g/cm) | 0.318 | 0.278 | 0.383 | 0.328 |

Under each of the four bonding conditions in Examples 1–8, a dramatic improvement in MVTR can be seen when the sheet produced under the new hydrocarbon based spinning conditions (Condition B) is compared against sheet produced under conventional FREON®-11 spinning conditions (Condition A). These MVTR improvements are in each side-by-side comparison accompanied by a modest increase in liquid barrier (hydrostatic head). The MVTR of the Condition B samples were on average 54.2% better than that of the samples spun under Condition A. This is especially significant because the liquid barrier (hydrostatic head) offered by the new more air permeable material produced according to Condition B is on average about 30% greater than the liquid barrier provided by the conventional samples spun under Condition A. When one compares samples of the conventional product (Condition A) and the new product (Condition B) having the same delamination strength (meaning that the sheets are bonded to the same degree but not necessarily under the same bonding conditions) such as Examples 5 and 8 above, it can be seen that the MVTR for the new product is significantly higher than the MVTR for the conventional product while the liquid barrier (hydrostatic head) for the new product is also higher than for the conventional product.

Examples 9–15

In the Examples 9–15, nonwoven sheets were flash-spun from the high density polyethylene of Examples 1–8. The sheets were spun as described above from a spin solution comprised n-pentane and high density polyethylene. The flash-spinning conditions were varied by changing the concentration of the polymer in the spin solution and by altering the spinning temperature. The sheets were all thermal bonded using a linen and "P" point pattern under the same conditions (bonding pressure of 5515 kPa (800 psi) on a 34" calendar bonder with steam pressure at 483 kPa-gauge (70 psig), and without mechanical softening). The polymer concentration and spin solution temperature used in making each sample and the properties of the samples are reported in Table 2, below.

TABLE 2

| | Ex. 9 | Ex. 10 | Ex. 11 | Ex. 12 |
|---|---|---|---|---|
| Spinning Conditions | | | | |
| Concentration (%) | 22 | 18 | 16 | 16 |
| Solution Temp. (° C.) | 175 | 189 | 175 | 185 |
| Physical Properties | | | | |
| MVTR (g/m$^2$/day) | 1201 | 1306 | 1038 | 1330 |
| MVTR-LYSSY (g/m$^2$/day) | 1204 | 1470 | 1235 | 1554 |
| Hydrostatic Head (cm) | 79 | 163 | 203 | 201 |
| Gurley Hill Porosity (seconds) | 52 | 89 | 339 | 77 |
| Basis Weight (g/m$^2$) | 40.5 | 40.5 | 40.5 | 40.5 |
| Delamination (N/m) | 24.5 | 10.5 | 24.5 | 26.5 |
| Crock Meter - Linen Side (# of Strokes) | 25 | 15 | 22 | 20 |
| Crock Meter - "P" Side (# of Strokes) | 20 | 10 | 25 | 16 |
| Tensile Strength MD (N/m) | 1600 | 1950 | 2300 | 1750 |
| Tensile Strength XD (N/m) | 1950 | 2100 | 2650 | 1600 |
| Elongation MD (%) | 14 | 16 | 15 | 17 |
| Elongation XD (%) | 23 | 22 | 20 | 25 |
| Work to Break MD (N-m) | 0.6 | 0.7 | 0.8 | 0.7 |
| Work to Break XD (N-m) | 0.9 | 0.9 | 1.0 | 0.8 |
| Tongue Tear MD (N/m) | 350 | 350 | 350 | 350 |
| Tongue Tear XD (N/m) | 550 | 350 | 550 | 350 |

| | Ex. 13 | Ex. 14 | Ex. 15 |
|---|---|---|---|
| Spinning Conditions | | | |
| Concentration (%) | 14 | 14 | 12 |
| Solution Temp. (° C.) | 175 | 184 | 175 |
| Physical Properties | | | |
| MVTR (g/m$^2$/day) | 1175 | 1333 | 1245 |
| MVTR-LYSSY (g/m$^2$/day) | 1243 | 1368 | 1389 |
| Hydrostatic Head (cm) | 175 | 232 | 196 |
| Gurley Hill Porosity (seconds) | 200 | 84 | 161 |
| Basis Weight (g/m$^2$) | 44 | 40.5 | 40.5 |
| Delamination (N/m) | 23 | 24.5 | 61.5 |
| Crock Meter - Linen Side (# of Strokes) | 25 | 25 | 25 |
| Crock Meter - "P" Side (# of Strokes) | 24 | 24 | 25 |
| Tensile Strength MD (N/m) | 1750 | 1950 | 1950 |
| Tensile Strength XD (N/m) | 1950 | 2300 | 2300 |
| Elongation MD (%) | 27 | 23 | 29 |
| Elongation XD (%) | 39 | 37 | 49 |
| Work to Break MD (N-m) | 1.0 | 1.0 | 1.2 |
| Work to Break XD (N-m) | 1.5 | 1.2 | 1.5 |
| Tongue Tear MD (N/m) | 350 | 350 | 175 |
| Tongue Tear XD (N/m) | 350 | 350 | 175 |

Examples 9–15 demonstrate that high MVTR can be achieved at a variety of polymer concentrations when plexifilamentary sheet material is flash spun from a hydrocarbon-based spin agent, even in the absence of mechanical softening. The Gurley Hill Porosity values for Examples 9–15 would be expected to be substantially lower if mechanical softening were present. In addition, Example pairs 11–12 and 13–14 show that increasing the solution spin temperature while keeping the polymer concentration constant also results in both higher MVTR and lower Gurley Hill (i.e., higher porosity), without any significant reduction in liquid barrier properties (hydrostatic head).

Examples 16–21

In the Examples 16–21, nonwoven sheets were flash-spun from the high density polyethylene of Examples 1–8. The sheets were spun as described above from a spin solution comprised FREON®-11 and high density polyethylene. The flash-spinning conditions were varied by changing the concentration of the polymer in the spin solution and by altering the spinning temperature. The sheets were all thermally bonded (rib and linen pattern) and softened at commercial conditions similar to those used for conventional 1.2 oz/yd$^2$ TYVEK® used in the protective apparel market. The oil temperature range for the rib and linen embossers was 160°–190° C. and the pin roll penetration for softening was 0.045 inch (1.14 cm). The polymer concentration and spin solution temperature used in making each sample and the properties of the samples are reported in Table 3, below.

TABLE 3

| | Ex. 16 | Ex. 17 | Ex. 18 |
|---|---|---|---|
| Spinning Conditions | | | |
| Concentration (%) | 11 | 11 | 11 |
| Spin Temp. (° C.) | 180 | 186 | 189 |
| Physical Properties | | | |
| MVTR-LYSSY (g/m$^2$/day) | 1356 | 1454 | 1460 |
| MVTR (g/m$^2$/day) | — | — | — |
| Hydrostatic Head (cm) | 107 | 121 | 120 |
| Gurley Hill Porosity (seconds) | 9 | 9 | 9 |
| Basis Weight (g/m$^2$) | 40.3 | 40.3 | 40.7 |
| Delamination (N/m) | 12 | 12 | 14 |
| Tensile Strength MD (N/m) | 1346 | 1557 | 1261 |
| Tensile Strength XD (N/m) | 1561 | 1492 | 1338 |
| Elongation MD (%) | 12.9 | 11.02 | 9.42 |
| Elongation XD (%) | 19.4 | 18.38 | 15.69 |
| Work to Break MD (N-m) | 0.357 | 0.339 | 0.227 |
| Work to Break XD (N-m) | 0.580 | 0.496 | 0.392 |
| Tongue Tear MD (N/m) | 412 | 349 | 370 |
| Tongue Tear XD (N/m) | 403 | 389 | 385 |

| | Ex. 19 | Ex. 20 | Ex. 21 |
|---|---|---|---|
| Spinning Conditions | | | |
| Concentration (%) | 10 | 10 | 9 |
| Spin Temp. (° C.) | 189 | 195 | 189 |
| Physical Properties | | | |
| MVTR-LYSSY (g/m$^2$/day) | 1546 | 1575 | 1463 |
| MVTR (g/m$^2$/day) | — | — | 1438 |
| Hydrostatic Head (cm) | 131 | 124 | 188 |
| Gurley Hill Porosity (seconds) | 13 | 9 | 11 |
| Basis Weight (g/m$^2$) | 40.7 | 40.7 | 41.0 |
| Delamination (N/m) | 11 | 12 | 14 |
| Tensile Strength MD (N/m) | 1408 | 1658 | 1450 |
| Tensile Strength XD (N/m) | 1564 | 1487 | 1750 |
| Elongation MD (%) | 10.54 | 9.43 | 10.6 |
| Elongation XD (%) | 16.93 | 15.61 | 17.5 |
| Work to Break MD (N-m) | 0.305 | 0.325 | 0.33 |
| Work to Break XD (N-m) | 0.487 | 0.400 | 0.60 |
| Tongue Tear MD (N/m) | — | 352 | 260 |
| Tongue Tear XD (N/m) | 349 | 401 | 330 |

Examples 16–21 demonstrate that when flash-spinning sheet material from a FREON®-based spin solution, MVTR can be improved, without any significant loss in liquid barrier (hydrostatic head), by increasing the spin solution temperature while the polymer concentration is held constant. Importantly, the results in Examples 16–21 also demonstrate that sheets with equivalent MVTR and improved Gurley Hill porosity properties can be obtained using a FREON®-based spin solution, as compared to the MVTR and Gurley Hill porosity properties of sheets made using the conventional 12% polymer concentration and 180° C. spin temperature (see Example 33).

Examples 22–25

In Examples 22–25, samples of flash-spun polyethylene sheet material made according to a variety of process conditions were tested. In Examples 22–25, a nonwoven sheet was flash-spun from the high density polyethylene of Examples 1–8. The sheet was spun as described above from a spin solution of high density polyethylene in a solvent that was either FREON®-11 ("F") or n-pentane hydrocarbon ("H"). The sheets were bonded as described below. The polymer concentration (weight % of solution) and spin solution temperature used in making each sample are reported in Table 4, below.

The samples in Examples 22, 24 and 25 were point bonded on a 34" laboratory thermal bonder under duplicate conditions using a linen and "P" point pattern and they were not mechanically softened. The sheet of Example 23 was thermally bonded (rib and linen pattern) and softened at commercial conditions similar to those used for conventional 1.2 oz/yd$^2$ TYVEK® used in the protective apparel market. The oil temperature range for the rib and linen embossers was 160°–190° C. and the pin roll penetration for softening was 0.045 inch (1.14 cm).

Example 24 corresponds to Example 11 above. Example 25 corresponds to Example 12 described above.

TABLE 4

| | Ex. 22 | Ex. 23 | Ex. 24 | Ex. 25 |
|---|---|---|---|---|
| Spinning/Bonding Conditions | | | | |
| Solvent | F | F | H | H |
| Polymer Concentration (%) | 12 | 11 | 16 | 16 |
| Solution Temperature (° C.) | 180 | 186 | 175 | 185 |
| Thermal Point Bonding? | Yes | Yes | Yes | Yes |
| Mechanical Softening? | No | Yes | No | No |
| Fiber Size Distribution | | | | |
| Mean (microns) | 18.2 | 11.0 | 12.6 | 13.3 |
| Standard Deviation | 19.6 | 10.9 | 9.0 | 12.0 |
| Physical Properties | | | | |
| Hydrostatic Head (cm) | 172 | 152 | 203 | 201 |
| MVTR (g/m$^2$/day) | 541 | 1419 | 1038 | 1330 |
| Gurley Hill Porosity (sec) | >180 | 11.1 | 339 | 77 |
| Thickness (microns) | 130 | 370 | 170 | 210 |
| Basis Weight (g/m$^2$) | 42.7 | 43.1 | 40.5 | 40.5 |

In the foregoing examples it should be noted that where the spin agent was FREON®-11, the lower polymer concentration, higher spinning temperature sample (Ex. 23) had smaller fiber sizes than the sample made with a higher polymer concentration and a lower spinning temperature (Ex. 22), which has apparently translated to dramatically increased MVTR and substantially improved permeability (lower Gurley seconds).

Examples 26–32

In the Examples 26–32, nonwoven sheets were flash-spun from the high density polyethylene of Examples 1–8. The sheets were spun as described above from a spin solution comprised FREON®-11 and high density polyethylene. The flash-spinning conditions were varied by changing the concentration of the polymer in the spin solution and by altering the spinning temperature. The sheets were all thermally whole-surface bonded on both sides using either a large roll bonder like that described in U.S. Pat. No. 3,532,589 to David ("large roll") or a smaller roll calendar bonder like that described in U.S. Pat. No. 4,652,322 to Lim ("small roll"). Where indicated, the bonded sheets were corona treated at a Watt density of 2.0 Watt-min/ft$^2$. The corona treatment causes oxidation of the surface which increases the hydrophilicity of the sheet material to make the material more suitable to liquid filtration end use applications. The polymer concentration and spin solution temperature used in making each sample and the properties of the samples are reported in Table 5, below.

The sample in Example 26 is TYVEK® Style T 980 sheet material currently sold for wastewater filtration. The sample in Example 27 is TYVEK® Style 1042B sheet material currently sold for liquid filtration. The sample in Example 28 is TYVEK® Style 1059B sheet material currently sold for sterile packaging. The samples in Examples 29–32 are the flash-spun fine fiber sheet material of the present invention. Measurements taken in English units have been converted to metric units.

TABLE 5

| | Ex. 26 | Ex. 27 | Ex. 28 |
|---|---|---|---|
| Spinning/Bonding Conditions | | | |
| Polymer Concentration (%) | 12 | 12 | 12 |
| Spin Temp. (° C.) | 180 | 180 | 180 |
| Bonder | small roll | large roll | large roll |
| Bonding Steam Pressure (lbs) | — | 67 | 76.5 |
| Roll Oil Temp. (° C.) | 115–140 | — | — |
| Corona Treatment | Yes | No | No |
| Physical Properties | | | |
| Basis Weight (g/m$^2$) | 30.5 | 42.4* | 64.4* |
| Thickness (microns) | 82 | 122* | 165* |
| Mean Flow Pore Size (microns) | 4.138 | 2.826 | — |
| Filter Efficiency- 1–2 microns particles @ 207 kPa (%) | 99.99 | 99.94 | 99.63 |
| Filter Life @ 207 kPa pressure differential (g and min) | 1.2 g in 8 min. | 2.0 g in 19 min. | 0.25 g in 5 min. |
| Permeability-Pressure Drop (kPa) @ 12.55 ml/min/cm$^2$ | 30.3 | 40.0 | 28.3 |
| MVTR-LYSSY (g/m$^2$/day) | 1589 | 1541 | 1374 |
| Gurley Hill Porosity (seconds) | 7 | 11* | 22* |
| Hydrostatic Head (cm) | 71.7 | 117 | 150* |
| Delamination (N/m) | 34.0 | 57.8* | 87.6* |
| Tensile Strength MD (N/m) | 1930 | 3327* | 6199* |
| Tensile Strength XD (N/m) | 3683 | 3678* | 7023* |
| Elongation MD (%) | 16.56 | 15.0 | 19.0 |
| Elongation XD (%) | 4.77 | 20.0 | 23.0 |
| Work to Break MD (N-m) | 0.64 | 0.99 | 2.49 |
| Work to Break XD (N-m) | 0.33 | 1.54 | 3.05 |
| Elmendorf Tear MD (N) | 4.05 | 3.78 | 3.25* |
| Elmendorf Tear XD (N) | 2.70 | 3.29 | 3.34* |

| | Ex. 29 | Ex. 30 | Ex. 31 | Ex. 32 |
|---|---|---|---|---|
| Spinning/Bonding Conditions | | | | |
| Polymer Concentration (%) | 11 | 11 | 11 | 11 |
| Spin Temp. (° C.) | 189 | 190 | 190 | 195 |
| Bonder | large roll | large roll | large roll | small roll |
| Bonding Steam Pressure (lbs) | 67 | 67.7 | 67 | — |
| Corona Treatment | Yes | Yes | Yes | Yes |
| Physical Properties | | | | |
| Basis Weight (g/m$^2$) | 42.4 | 42.7 | 42.7 | 45.4 |
| Thickness (microns) | 137 | 128 | 136 | 144.5 |

TABLE 5-continued

| | | | | |
|---|---|---|---|---|
| Mean Flow Pore Size (microns) | 6.417 | 3.672 | 5.935 | 3.943 |
| Filter Efficiency- 1–2 microns particles @ 207 kPa (%) | 99.96 | 99.98 | 99.95 | 99.93 |
| Filter Life @ 207 kPa pressure differential (g and min) | 3.0 g in 28 min | 1.5 g in 7 min | 1.3 g in 7 min | 3.2 g in 24 min |
| Permeability-Pressure Drop (kPa) @ 12.55 ml/min/cm$^2$ | 15.2 | 9.0 | 6.9 | 16.2 |
| MVTR-LYSSY (g/m$^2$/day) | 1524 | 1735 | 1852 | 1383 |
| Gurley Hill Porosity (seconds) | 5.03 | 5.00 | 3.57 | 3.29 |
| Hydrostatic Head (cm) | 83.8 | 76.5 | 54.9 | 20.96 |
| Delamination (N/m) | 27.5 | 35.6 | 30.1 | 46.2 |
| Tensile Strength MD (N/m) | 3324 | 4033 | 3431 | 4179 |
| Tensile Strength XD (N/m) | 3641 | 3968 | 3221 | 4429 |
| Elongation MD (%) | 11.94 | 15.56 | 13.50 | 16.33 |
| Elongation XD (%) | 18.06 | 19.38 | 18.47 | 20.07 |
| Work to Break MD (N-m) | 0.81 | 1.21 | 0.93 | 1.30 |
| Work to Break XD (N-m) | 1.34 | 1.52 | 1.19 | 1.71 |
| Elmendorf Tear MD (N) | 5.27 | 3.71 | 4.35 | 2.97 |
| Elmendorf Tear XD (N) | 4.67 | 3.70 | 4.46 | 3.33 |

*Represents average for commercial product

In the foregoing Examples 26–32, it should be noted that the sheet material that was flash-spun at elevated spinning temperatures and reduced polymer concentrations according to the invention (Exs. 29–32) displayed high liquid permeability without any significant reduction in filtration efficiency as compared to conventional flash-spun sheet material (Exs. 26–28). The improved permeability of the sheet material of the invention (Exs. 29–32) resulted in a pressure drop across the material that was only 25% to 50% of the pressure drop experienced with the comparable conventional flash spun sheet materials in Examples 26 and 27. Most important, the increased permeability of the sheet materials in Examples 29–32 was achieved while maintaining a filtration efficiency for 1–2 micron particles greater than 99.9% and without any significant loss in tensile or tear strength. The combination of greatly improved liquid permeability with excellent filtration efficiency and sheet strength has great advantages for liquid filtration applications, such as the filtration of heavy metals from a liquid waste stream.

Examples 33–37

In the Examples 33–37, nonwoven sheet material suitable for use in sterile packaging was flash-spun from the high density polyethylene of Examples 1–8, and was tested for bacterial spore penetration. The sheets were spun as described above from a spin solution comprised FREON®-11 and high density polyethylene. The flash-spinning conditions were varied by changing the concentration of the polymer in the spin solution and by altering the spinning temperature. The sheets were all thermally whole-surface bonded on both sides using a large roll bonder like that described in U.S. Pat. No. 3,532,589 to David. Where indicated, the bonded sheets were corona treated at a Watt density of 2.0 Watt-min/ft$^2$. The corona treatment changes the molecular structure of the sheet surface to polyethylene oxide. Corona treatment can be used to make the sheet material more wetable, which may be beneficial if the sheet material is to be printed. The polymer concentration and spin solution temperature used in making each sample and the properties of the samples are reported in Table 6, below.

The sample in Example 33 is TYVEK® Style 1042B sheet material currently sold for liquid filtration. The sample in Example 34 is TYVEK® Style 1059B sheet material currently sold for sterile packaging end use applications. The sample in Example 35 is TYVEK® Style 1073B sheet material currently sold for sterile packaging. The sample in Example 36 is the flash-spun fine fiber sheet material of the present invention that was corona treated. The sample in Example 37 is identical to the sample in Example 36 but for the absence of corona treatment.

TABLE 6

| | Ex. 33 | Ex. 34 | Ex. 35 |
|---|---|---|---|
| Spinning/Bonding Conditions | | | |
| Polymer Concentration (%) | 12 | 12 | 12 |
| Solution Temp. (° C.) | 180 | 180 | 180 |
| Bonding Steam Pressure (lbs) | 67 | 76.5 | 79 |
| Corona Treatment | No | No | No |
| Properties | | | |
| Basis Weight (g/m$^2$) | 42.4 | 64.4 | 74.6 |
| Thickness (microns) | 122 | 165 | 185 |
| Spore Log Reduction Value (LRV) | 2.85 | 4.15 | 5.27 |
| MVTR-LYSSY (g/m$^2$/day) | 1541 | 1374 | — |
| Gurley Hill Porosity (seconds) | 17.8 | 19.3 | 23.2 |

| | Ex. 36 | Ex. 37 |
|---|---|---|
| Spinning/Bonding Conditions | | |
| Polymer Concentration (%) | 11 | 11 |
| Solution Temp. (° C.) | 189 | 189 |
| Bonding Steam Pressure (lbs) | 67 | 67 |
| Corona Treatment | Yes | No |
| Properties | | |
| Basis Weight (g/m$^2$) | 42.4 | 42.4 |
| Thickness (microns) | 137 | 130.5 |
| Spore Log Reduction Value (LRV) | 2.97 | 2.72 |
| MVTR-LYSSY (g/m$^2$/day) | 1524 | 1611 |
| Gurley Hill Porosity (seconds) | 5.4 | 4.17 |

In the foregoing Examples 33–37, it can be seen that at a given basis weight of 42.4 g/m$^2$, the sheet material samples that were flash-spun at elevated spinning temperatures and reduced polymer concentrations according to the invention (Examples 36 and 37) passed 100 cubic centimeters of air under the standard conditions of the Gurley Hill Porosity test in less than one third the time that was required to pass the same amount of air under the same conditions through a sample of conventional sheet material of the same basis weight (Ex. 33). Most importantly, the new sheet material of Examples 36 and 37 exhibited this substantial improvement in air porosity without a sacrifice in bacterial barrier properties. The spore log reduction values of 2.97 and 2.72 measured for the new sheet materials of Examples 36 and 37, respectively, were not significantly different than the spore log reduction value of 2.85 measured for the far less porous conventional sheet material of the same basis weight (Example 33). This combination of significantly improved air porosity without loss of bacterial barrier properties is very beneficial for sterile packaging materials where air and other sterilizing gases must be pumped in and out of sterile packages without the passage of bacteria.

The foregoing description, examples and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. The scope of any patent rights granted on this application should be measured and determined by the claims that follow.

We claim:

1. A sheet material suitable for use in microfiltration of liquids having a water permeability that causes a pressure drop of less than 21 kPa at a water flow rate per unit area of 12.55 ml/min/cm$^2$, and that has a filtration efficiency, according to ASTMF 795-82, of at least 99% of dust particulates in the size range of 1 to 2 microns suspended in a stream of distilled water being pumped through the sample at a rate that results in a pressure differential across the sample of 207 kPa.

2. The sheet material of claim 1 wherein the sheet material is comprised substantially exclusively nonwoven fibers.

3. The sheet material of claim 2 wherein the sheet material is comprised of a unitary sheet of nonwoven fibers.

4. The sheet material of claim 3 wherein said nonwoven fibers are flash-spun plexifilamentary fibrils comprised of polyolefin polymer.

5. The sheet material of claim 4 wherein said polyolefin is high density polyethylene.

6. The sheet material of claim 2 wherein the basis weight of the sheet material is less than about 45 g/m$^2$.

7. The sheet material of claim 6 wherein the sheet material has a tensile strength in both the machine and cross directions of at least 1500 N/m.

8. The sheet material of claim 6 wherein the sheet material has a tensile strength in both the machine and cross directions of at least 3000 N/m.

9. The sheet material of claim 7 wherein the sheet material has an Elmendorf tear strength in both the machine and cross directions of at least 2.5 N.

10. The sheet material of claim 3 wherein the sheet material has a basis weight of at least 38 g/m$^2$, and has a Gurley Hill Porosity, measured according to TAPPI T-460 OM-88, of less than 10 seconds.

11. A sheet material suitable for use in sterile packaging having a Gurley Hill Porosity, measured according to TAPPI T-460 OM-88, of less than 15 seconds and a spore log reduction value, measured according to ASTM F 1608-95, of at least 2.5.

12. The sheet material of claim 11 wherein the sheet material has a Gurley Hill Porosity, measured according to TAPPI T-460 OM-88, of less than 10 seconds.

13. The sheet material of claim 11 wherein the sheet material has a moisture vapor transmission rate, measured according to the MVTR-LYSSY method, of at least 1300 g/m$^2$/day.

14. The sheet material of claim 11 wherein the sheet has a basis weight of at least 35 g/m$^2$.

15. The sheet material of claim 11 wherein the sheet has a basis weight between 38 g/m$^2$ and 48 g/m$^2$.

16. The sheet material of claim 15 wherein the sheet material is comprised substantially exclusively of nonwoven fibers.

17. The sheet material of claim 16 wherein the sheet material is comprised of a unitary sheet of nonwoven fibers.

18. The sheet material of claim 17 wherein said nonwoven fibers are flash-spun plexifilamentary fibrils comprised of polyolefin polymer.

19. The sheet material of claim 18 wherein said polyolefin is high density polyethylene.

* * * * *